US007458880B2

(12) United States Patent
Fritz et al.

(10) Patent No.: US 7,458,880 B2
(45) Date of Patent: Dec. 2, 2008

(54) METHOD FOR GRINDING OF CAM PROFILES

(75) Inventors: Oliver Fritz, Aichtal (DE); Rolf Kirschner, Esslingen (DE); Roland Schacherer, Geisingen (DE); Falk Schneider, Korntal-Münchingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 11/803,110

(22) Filed: May 11, 2007

(65) Prior Publication Data

US 2007/0264913 A1 Nov. 15, 2007

(30) Foreign Application Priority Data

May 13, 2006 (DE) ..... 10 2006 022 405
Sep. 19, 2006 (DE) ..... 10 2006 044 010

(51) Int. Cl.
*B24B 1/00* (2006.01)

(52) U.S. Cl. ..... 451/49; 451/54; 451/55; 451/62; 451/249; 451/251

(58) Field of Classification Search ..... 451/49, 451/53, 54, 55, 62, 246, 249, 251
See application file for complete search history.

(56) References Cited

U.S. PATENT DOCUMENTS 4,099,349 A * 7/1978 Asano ..... 451/239
5,556,321 A * 9/1996 Kasahara et al. ..... 451/5
6,390,907 B1 * 5/2002 Metzler et al. ..... 451/360
6,485,353 B1 11/2002 Laycock et al.
2007/0039172 A1 2/2007 Fritz et al.

FOREIGN PATENT DOCUMENTS

DE 699 04 628 T2 10/2003
GB 2324487 A 10/1998
WO WO 2006/015570 A1 2/2006

* cited by examiner

*Primary Examiner*—Eileen P. Morgan
(74) *Attorney, Agent, or Firm*—Collard & Roe, P.C.

(57) ABSTRACT

The present invention relates to a method for grinding of cam profiles on a camshaft (1), having an inner shaft (5) and an outer shaft (4) arranged coaxially one inside the other and mounted to rotate with respect to one another. The camshaft (1) additionally has first and second cams (2, 3) that can rotate with respect to one another over a limited circumferential angle about the camshaft axis (6), the first cams (2) of which are fixedly connected to the inner shaft (5) and the second cams (3) of which are fixedly connected to the outer shaft (4). It is essential to this invention that during and/or after the grinding operation a fluid is forced under pressure into the outer shaft (4), thereby preventing penetration of grinding dust into the interspace (8) between the first cams (2) and the outer shaft (4) or flushing out any grinding dust that has already penetrated.

7 Claims, 2 Drawing Sheets

METHOD FOR GRINDING OF CAM PROFILES

CROSS REFERENCE TO RELATED APPLICATIONS

Applicants claim priority under 35 U.S.C. §119 of German Application No. 10 2006 022 405.1 filed May 13, 2006 and German Application No. 10 2006 044 010.2 filed Sep. 19, 2006.

The invention relates to a method for grinding of cam profiles on a camshaft according to the preamble of Claim 1.

Camshafts are machine elements with which a rotational movement can be repeatedly converted into a short longitudinal movement so that, for example, intake and exhaust valves of a combustion engine can be opened. In contrast with previous camshafts, worked camshafts have been used for some time because they offer advantages with regard to lower cost, lower weight, higher strength materials and greater flexibility in manufacturing. After assembling the worked camshafts, they are usually ground and the surfaces of the cams are hardened. In the case of camshafts with mutually adjustable cams, however, there is the risk with the traditional grinding in particular that grinding dust may collect in open cavities and impair the functioning of the camshaft and/or the internal combustion engine in subsequent operation.

The present invention relates to the problem of providing an improved embodiment for a method for grinding of cam profiles on a camshaft of the generic type in which the finished ground camshaft does not suffer any negative effects due to deposited grinding dust.

This problem is solved according to this invention by the subject of the Independent Claim 1. Advantageous embodiments are the subject of the dependent claims.

The invention is based on the general idea of a camshaft having an inner shaft and an outer shaft arranged coaxially one inside the other and mounted with respect to one another and first and second cams that can rotate with respect to one another about the camshaft axis over a limited circumferential angle are acted upon by a fluid from the inside during the grinding operation and/or thereafter in such a way that the fluid escapes through openings arranged in the outer shaft and thereby prevents the penetration of grinding dust into a ring gap between the first cam and the outer shaft or rinses out in a grinding dust that has already penetrated during the grinding operation. The first cams are fixedly connected to the inner shaft and the second cams are fixedly connected to the outer shaft, whereby the connection of the first cams to the inner shaft is preferably accomplished via connecting pins which are guided in elongated holes running in the circumferential direction in the outer shaft. A ring gap is formed between these first cams and an outside surface of the outer shaft; grinding dust can collect in this ring gap during grinding of the cam profiles and thereby impair the functioning of the future camshaft. By forcing fluid under pressure into the outer shaft, the fluid passes through the openings, e.g., the elongated holes arranged in the circumferential direction, and prevents deposition and/or penetration of grinding dust through the outlet opening into the interspaces between the first cam and the outer shaft. The fluid may be forced into the outer shaft during the grinding operation, so that penetration of grinding dust into the interspaces/ring gap is prevented even during the grinding operation or only after the grinding operation so that grinding dust that has penetrated during grinding is rinsed back out of the interspace by the fluid emerging. It is of course also conceivable for the interspace to be rinsed with fluid during and/or after the grinding operation.

Through the inventive method, it is possible to remove grinding dust from the interspaces, which should otherwise be kept clean and/or to completely prevent penetration of grinding dust into the interspaces, so that subsequent cleaning of these interspaces, which is difficult and often unsatisfactory, may be omitted. Keeping the grinding dust away from the interspaces/ring gaps and/or removing it therefrom ensures a high functional reliability of the finished camshaft and minimizes the risk of production breakdowns.

In an advantageous embodiment of the inventive approach, the pressure of the fluid during the grinding operation is set so high that the outer shaft undergoes elastic deformation and the ring gap between the first cams and the outer shaft must at least be reduced. This offers the advantage that it is very difficult for grinding dust to penetrate into the reduced ring gap and furthermore an increased velocity of flow of the fluid prevails in these reduced ring gaps, so that cleaning of the interspaces is possible at the same time. After the grinding operation, the outer shaft undergoes elastic deformation due to the declining internal pressure, recoiling back, so that the ring gap resumes its original size which it had before the grinding operation.

In another advantageous embodiment of the inventive approach, the pressure of the fluid is selected to be so high during grinding that the outer shaft undergoes elastic deformation and the first cams are in close contact with an outer lateral surface of the outer shaft. This offers the great advantage that the first cams are fixedly connected to the outer shaft and are arranged in a rotationally fixed mount thereon. This facilitates chucking and/or fixation of the camshaft during the grinding operation and also increases the grinding precision and thus the quality of the camshaft manufactured with the inventive grinding method. Here again, the deformation of the outer shaft is in the elastic range, so that due to the decline in pressure, after the end of the grinding operation, the outer shaft resumes its original shape, which it had before the grinding operation, and therefore there is no impairment in the functionality of the camshaft. Furthermore, in this variant, the ring gap is closed during the grinding so that no grinding dust can penetrate into it.

The increased grinding precision is derived from the following.

For turnability on the outer shaft, the first cams that are fixedly connected to the inner shaft require a radial play. This play determines the ring gap into which grinding dust can enter. In the case of grinding of the first cams, they are pressed against the outer shaft under the pressure of the grinding tool in the radial direction of the grinding pressure exerted by the grinding tool, namely eliminating the radial play in running. In grinding, this yields a lack of dimensional accuracy, corresponding to the displaced play on the finished ground first cams. During operation of the camshaft, the play prevails again, so that the outer contours of the first cams cannot necessarily identically correspond to the respective contours during grinding with respect to the camshaft axis.

With the traditional grinding method without elastic widening of the outer shaft, a lower grinding precision may therefore be expected. As an alternative, only the second cams fixedly connected to the outer shaft can be ground by the traditional method.

Expediently, filtered oil is used as the hydraulic medium. Such a hydraulic medium may also be used to bind dirt, i.e., grinding dust in particular, and may subsequently also be filtered through a filter system, for example, and returned back to the grinding operation. Due to the use of filtered oil, soiling of the interspaces between the first cams and the outer shaft is prevented so that a high quality can be guaranteed.

Other important features and advantages of the invention are derived from the subclaims, the drawings and the respective description of the figures on the basis of the drawings.

It is self-evident that the features mentioned above and those yet to be described below may be used not only in the particular combination given but also in other combinations or alone without going beyond the scope of the present invention.

BRIEF DESCRIPTION OF THE DRAWINGS

Preferred exemplary embodiments of the invention are depicted in the drawings and explained in greater detail in the following description.

They show, each in schematic diagrams:

According to FIG. 1, a camshaft 1 is shown, having several mutually adjustable cams, namely first cams 2 and second cams 3. FIG. 2 shows the design of the camshaft 1 on the basis of a longitudinal section, which shows that the camshaft 1 consists of two shafts, namely an outer shaft 4 and an inner shaft 5 arranged coaxially in the outer shaft 4. The inner shaft 5 is mounted with respect to the outer shaft 4 so that the inner shaft 5 is able to rotate about a joint longitudinal axis 6 independently of the outer shaft 4 at least over a limited angular range.

To achieve and adjustment of the first cams 2 with respect to the second cams 3, the first cams 2 are fixedly connected to the inner shaft 5 while the second cams 3 are fixedly connected to the outer shaft 4. The connection between the second cams 3 and the outer shaft 4 may be accomplished by means of a shrink fit, for example. The connection of the first cams 2 to the inner shaft 5 is usually implemented via connecting pins 7 which are arranged essentially across the longitudinal axis 6 and the outer shaft 4 passes through longitudinal holes arranged in the circumferential direction therein. The length of the longitudinal hole aligned in the circumferential direction limits the angle of adjustment between the first cams 2 and the second cams 3. Since the first cams 2 are arranged so they are rotatable with respect to the outer shaft 4, there must be an interspace 8, even if minimal, designed in the form of a ring gap between the first cam 2 and the outer shaft 4. The camshaft 1 shown in FIG. 1 and/or FIG. 2 is a so-called worked camshaft in which the cams 2, 3 are connected to the corresponding shafts 4, 5 during assembly.

Figure 1:
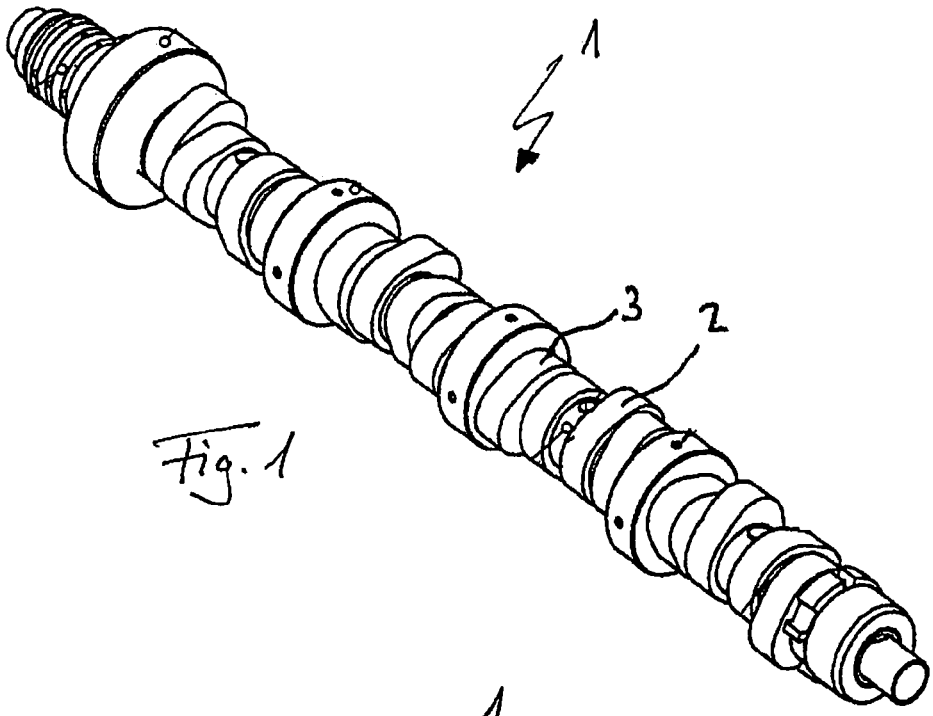
FIG. 1 a view of a camshaft having mutually adjustable cams.

Before installation of the camshaft 1 in a corresponding crankcase (not shown) it is necessary for the cam profiles of the first and second cams 2, 3 to be ground. Cam profiles are understood to refer to a circumferential lateral surface of the cams 2, 3. In grinding the cam profiles, there is the problem that grinding dust can enter the interspace/ring gap 8 between the first cam 2 and the outer shaft 4 and thereby can impair the subsequent functionality of the camshaft 1. This is where the inventive method for grinding of cam profiles offers a remedy.

According to the inventive method, during and/or after the grinding operation, a fluid under pressure is forced into the outer shaft 4, i.e., into a cavity 9 and therefore penetration of grinding dust into the interspace 8 between the first cams 2 and the outer shaft 4 is prevented or grinding dust that has already penetrated is flushed out again.

A fluid should be understood to refer in general to a liquid, in particular a hydraulic oil, or a gas, in particular air or compressed air.

When fluid is forced into the outer shaft 4 and/or the hollow space 9 during the grinding operation, it continuously penetrates outward through the interspace 8, creating a volume flow in the interspace 8, thereby preventing grinding dust from entering. Grinding dust could then penetrate only if it moves against the volume flow outward from the hollow space 9 through the interspace 8 to the outside, which is physically impossible. Additionally or alternatively, it is possible to provide for the fluid under pressure to be pressed into the outer shaft 4 after the grinding operation and thereby to rinse the grinding dust that has penetrated into the interspace 8 back out of it again during the grinding process without any application of fluid. In both cases, it may be assumed that no grinding dust is to be encountered in the interspace 8 after the cam profile grinding operation and/or after rinsing out the interspace 8, so no impairment of the function of the finished camshaft 1 need be expected.

When the fluid is forced into the shaft, in particular in the form of a liquid, during the grinding process, the injection pressure may be set so high that the outer shaft 4 undergoes elastic deformation and the interspaces 8 and/or the ring gaps 8 between the first cams 2 and the outer shaft 4 are at least reduced in size. Reduction of the interspace 8 at an elevated pressure results in the velocity of flow increasing in the interspace 8, thereby reliably suppressing any penetration of grinding dust. For the case when, only after the grinding operation, the fluid is forced under pressure into the outer shaft 4, the elastic deformation of the outer shaft 4 produces a smaller cross section of flow in the interspace 8 and therefore an increased velocity of flow, thereby improving the cleaning effect in the interspace 8.

When the pressure of the fluid is increased, i.e., in particular the pressure of the liquid, during the grinding operation, it is possible to achieve the result that the outer shaft 4 undergoes elastic deformation so that the first cams 2 are in close contact with an outer lateral surface of the outer shaft 4 and therefore the interspaces 8 are closed. Thus, penetration of grinding dust into the interspaces 8 is entirely impossible.

In both variants in which the pressure of the fluid leads to elastic deformation of the outer shaft 4, releasing the pressure results in an elastic re-deformation of the outer shaft 4, so that the first cams 2 can again be turned with respect to the outer shaft 4 with no problem. Fluid is forced in preferably from an axial end face 10, 10' of the camshaft 1, whereby openings 11 that run radially, such as an oil channel, may be sealed in advance in the bearings. It is also conceivable for an injection of fluid through the opening 11 to take place, in which case then the camshaft 1 is sealed at the end. It is important here that the same pressure is applied preferably on both ends of a seal 12 so that the seal 12 is not displaced.

To be able to increase the quality of the grinding process, filtered oil is preferably used as the fluid. This uncontaminated oil ensures that both the hollow space 9 and the interspace 8 are supplied with high-quality clean oil so that cleaning after the grinding operation may be omitted. In addition, it is conceivable that oil escaping due to the pressure might take up the dust and then be cleaned, i.e., filtered again to be able to be forced back into the hollow space 9 in the outer shaft 4.

As an alternative to this, in a particularly preferred embodiment, the fluid used is air, in particular compressed air. Compressed air is inexpensive on the one hand and on the other hand can easily be discharged into the environment after the grinding process without polluting the environment. Purification or expensive disposal, such as that which is required with a hydraulic medium, for example, may be omitted, so the grinding process can be implemented inexpensively.

Figure 2:
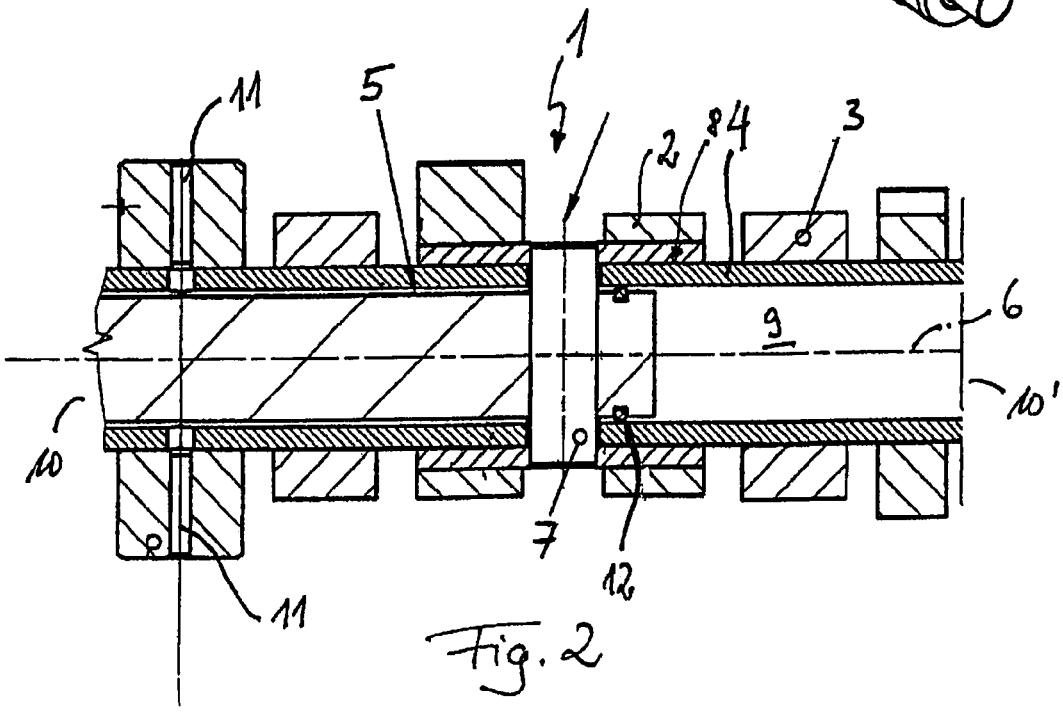
FIG. 2 a longitudinal section through an area of the camshaft.
Figure 3:
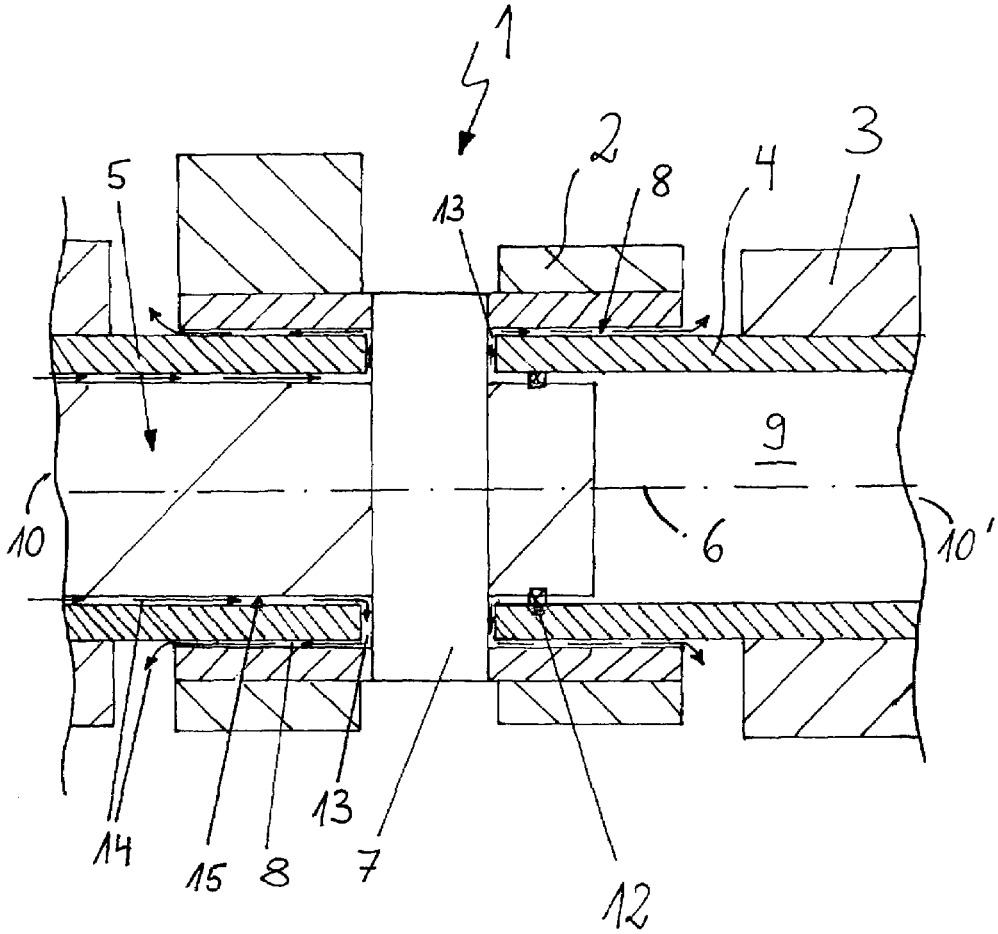
FIG. 3 another longitudinal section of an area of the camshaft.

FIG. 3 shows a more detailed enlargement from the original FIG. 2, from which the fluid flow can be clearly seen. On the basis of the flow direction, arrows 14 have now been drawn in, and show how the fluid is pressed into the outer shaft 4 when the cams 2 are being ground. To put it more precisely, the fluid flows between the inner shaft 5 and the outer shaft 4, and flows from this ring space 15 to the interspace 8 that lies between the outer shaft 4 and the cam 2. In this connection, radial outward flow occurs in the region of the connection pin 7, to put it more precisely, by way of the longitudinal hole 13 in which the connection pin is guided. For a better understanding, the longitudinal hole 13 has been labeled with the reference symbol 13 in this connection.

During or after grinding of the cam profiles, the interior 9 of the outer shaft 4, i.e. the ring space 15 that lies between the inner shaft 5 and the outer shaft 4, has fluid applied to it, specifically from the face 10 of the outer shaft 4. The inner shaft 5, which is connected with the first cams 2 so as to rotate with them, by way of a connection pin 7, is mounted in the hollow outer shaft 4 (see FIG. 2). In this regard, the connection pin 7 runs orthogonal to the shaft axis 6. In order to be able to bring about a rotation of the inner shaft 5 relative to the outer shaft 4, a longitudinal hole 13 that extends in the circumference direction is provided in the outer shaft 4, in known manner. Since the first cams 2 are disposed so as to rotate relative to the outer shaft 4, an interspace 8 must necessarily be present between the first cams 2 and the outer shaft 4, which is configured in the form of a ring gap. When a fluid that is under pressure is applied to the ring space 15, for example from the faces 10, this fluid will first flow in the ring space 15 between the inner shaft 5 and the outer shaft 4, to the connection pin 7. In the region of the connection pin 7, the fluid that is under pressure will enter into the interspace 8 disposed between the first cams 2 and the outer shaft 4, through the longitudinal hole 13 provided in the outer shaft 4 and extending in the circumference direction. In this connection, the fluid that is under pressure flows through the interspace 8 in accordance with the flow direction arrows 14 shown in the drawing, in the axial direction, and thereby prevents penetration of grinding dust into the interspace 8.

The invention claimed is:

1. A method for grinding of cam profiles on a camshaft (1), which camshaft (1)

has an inner shaft (5) and an outer shaft (4) arranged coaxially one inside the other and mounted with respect to one another, has first cams (2) and second cams (3) that can rotate with respect to one another about the camshaft axis (6) over a limited circumferential angle, the first cams (2) being fixedly connected to the inner shaft (5) and the second cams (3) being fixedly connected to the outer shaft (4), wherein during the grinding process and/or thereafter, the method includes: forcing fluid under pressure into the outer shaft (4), thereby forcing fluid into a ring space (15) between the inner shaft (5) and outer shaft (4), wherein the fluid flows through a longitudinal hole (13) and into a ring gap (8) between the first cam (2) and the outer shaft (4) thereby preventing grinding dust from penetrating into the ring gap (8) or flushing out any grinding dust that has already penetrated into the ring gap (8).

2. The method according to claim 1, wherein the pressure of the fluid during the grinding process is selected to be so high that the outer shaft (4) undergoes elastic deformation and ring gaps (8) between the first cams (2) and the outer shaft (4) are at least reduced in size.

3. The method according to claim 2, wherein the pressure of the fluid during the grinding process is selected to be so high that the outer shaft (4) undergoes elastic deformation and the first cams (2) are in close contact with an outer lateral surface of the outer shaft (4).

4. The method according to claim 1, wherein a hydraulic medium is used as the fluid.

5. The method according to claim 4, wherein purified oil is used as the hydraulic medium.

6. The method according to claim 1, wherein a gas is used as the fluid.

7. The method according to claim 6, wherein (compressed) air is used as the gas.

* * * * *